US007789816B2

(12) United States Patent
Krietzman

(10) Patent No.: US 7,789,816 B2
(45) Date of Patent: Sep. 7, 2010

(54) DYNAMIC VARIABLE RESISTANCE DUAL CIRCLING EXERCISE METHOD AND DEVICE

(76) Inventor: Mark Howard Krietzman, P.O. Box 3185, Palos Verdes, CA (US) 90274

( * ) Notice: Subject to any disclaimer, the term of this patent is extended or adjusted under 35 U.S.C. 154(b) by 0 days.

(21) Appl. No.: 12/109,311

(22) Filed: Apr. 24, 2008

(65) Prior Publication Data

US 2008/0312052 A1 Dec. 18, 2008

Related U.S. Application Data

(63) Continuation-in-part of application No. 10/893,201, filed on Jul. 17, 2004, now abandoned.

(60) Provisional application No. 60/914,614, filed on Apr. 27, 2007.

(51) Int. Cl.
*A63B 71/00* (2006.01)

(52) U.S. Cl. ..... 482/139; 482/5; 482/8

(58) Field of Classification Search ..... 482/8, 482/63, 148, 118, 119, 57, 139, 142, 1; 128/904
See application file for complete search history.

(56) References Cited

U.S. PATENT DOCUMENTS

| | | | | |
|---|---|---|---|---|
| 4,611,807 | A * | 9/1986 | Castillo | 482/119 |
| 4,720,099 | A * | 1/1988 | Carlson | 482/133 |
| 5,062,633 | A * | 11/1991 | Engel et al. | 482/118 |
| 5,466,203 | A * | 11/1995 | Chen | 482/63 |
| 2002/0091796 | A1 * | 7/2002 | Higginson et al. | 709/218 |
| 2002/0128119 | A1 * | 9/2002 | Arai | 482/8 |

* cited by examiner

*Primary Examiner*—Jerome Donnelly
(74) *Attorney, Agent, or Firm*—Luce, Forward, Hamilton & Scripps, LLP; Technology Law Group; Peter Gluck

(57) ABSTRACT

The present disclosure provides a method and device for exercise comprising having two bases each supporting a pivoting arm with a grip attached thereto with a rotating hub attached to each pivoting arm (wherein each hub has a magnetically attractive region thereon and each pivoting arm is movable around 360 degrees). Placing a movable magnetic device in close proximity to each hub (wherein moving the magnetic device will vary the magnetic field being applied to the hub), placing a user grasping the grips (between the bases) and moving the grips around a guided circular pathway and varying the magnetic field being applied to each hub, thereby adjusting the resistance being exercised with, during movement of the grip around one revolution.

6 Claims, 9 Drawing Sheets

DYNAMIC VARIABLE RESISTANCE DUAL CIRCLING EXERCISE METHOD AND DEVICE

RELATED APPLICATIONS

This application is a continuation in part of application Ser. No. 10/893,201 now abandoned entitled Dual Circling Exercise Method and Device filed Jul. 17, 2004 and the Provisional Application Ser. No. 60/914,614 filed Apr. 27, 2007 entitled Dynamic Variable Resistance Dual Circling Exercise Method and Device all of which are incorporated by reference herein.

BACKGROUND OF THE DISCLOSURE

1. Field of the Disclosure

This present invention relates to an exercise method and an exercise device. More specifically, to a circular exercise device and method using guided upper body circular motion with controlled and varied resistance selectively altered at least during a revolution of movement.

2. General Background

A variety of resistance exercise devices are known in the art. Upper body exercise devices generally involve a linear, or near linear stroke-type movement back and forth, or up and down to simulate weight lifting. The motion on these devices is substantially a back and forth or modified back and forth (up and down) linear motion. Running, biking or steeping exercise device to simulate biking, running or walking with connected pedals or treadles that move in a circle, or up and down are known.

Back and forth linear motion exercise devices often require the user to start and stop at the end of each stroke-type movement. Hand pedaling connected bicycle-type hand pedals on connected sprockets are known for physical rehabilitation. Arc oriented up and down motion devices are known based on the old principal of the user going back and forth or up and down in a range.

LIFECYCLE™ devices are well known in the art whereby a workout profile is imposed on an automatically adjusted magnetic resistance hub that varies the resistance to movement on a rotating hub as a function of time.

During human exercise movements are facilitated by a variety of muscle groups. The muscle groups in the arms, hands, back, neck, shoulders, torso, legs feet and the skeleton work synergistically to support the body and provide movement. For example, the forces a muscle or group of muscles in an arm must generate to move a weight or resistance (load) from one position to another position depend on many variables, the size of the muscle group (Biceps versus triceps), and the position of the load relative to the muscle group and joint at various points in time. It would therefore be a desideratum to have a non-linear motion exercise device and method to adjustably exercise within the varying limits different positional exercise requires.

SUMMARY

The present disclosure provides, in some exemplary implementations, a method and device for exercise comprising having two bases each supporting a pivoting arm, supported on a pivot and each arm has grip attached thereto. A rotating hub is attached to each pivot (wherein each hub has a magnetically attractive region thereon and each pivoting arm is movable around 360 degrees) and each hub's rotation corresponds to the connected arm's movement. Placing a movable magnetic device in close proximity to each hub (wherein moving the magnetic device will vary the magnetic field being applied to the hub), placing a user grasping the grips (between the bases) and moving the grips around a guided circular pathway and varying the magnetic field being applied to each hub, thereby adjusting the resistance being exercised with, during movement of the grip around one revolution. In some aspects the method includes the guided circular pathway includes moving the grips at least one of below the user's thighs and behind the user's front.

In some exemplary implementations of this two bases each of which support an arm on a pivot with a grip attached to the arm at one end. The arms are placed opposite one another and a rotating hub is attached to each pivot wherein each hub rotation corresponds to arm movement. Each hub has a magnetically attractive region. Further, each hub is divided into two or more zones and each pivoting arm is movable around 360 degrees. A movable magnetic device is placed in close proximity to each hub wherein moving the magnetic device will vary the magnetic field being applied to the hub. During use a user grasping the grips (between the bases) and moving the grips around a guided circular pathway. During movement about a revolution the magnetic field applied to each hub is varied thereby adjusting the resistance being exercised with when the user moves the arms. In some aspects the method includes the guided circular pathway placing the grips at least one of below the user's thighs and behind the user's front. In some aspects a sensor unit is associated with each hub to measure the movement of the position of the two or more zones and data provided from each sensor unit to vary the position of the magnetic device relative to each zone.

In some exemplary implementations of the disclosure there is a variable force exercise device and method. The device has at least two bases, each base supporting a 360 degree pivoting arm with a grip attached thereto. A rotating hub, with multiple zones identified thereon, is attached to each pivoting arm at a pivot. The hub is attached to each pivot whereby each hub rotation corresponds to arm movement. A magnetically attractive region is on each hub. A movable magnetic device in placed close proximity to each hub whereby moving the magnetic device will vary the magnetic field being applied to the magnetically attractive region of each hub and, a moving means which alters the position of the magnetic device at least during a single rotation. In some aspects a sensor to monitor or measure machine readable data corresponding to at least one of hub position, arm position, grip position and zone position relative to the sensor is supplied to the moving means.

In some exemplary implementations the device may comprise a controller whereby the movable magnetic device is moved corresponding at least in part to data provided by the sensor to the controller and/or to a processor.

In some exemplary implementations of the disclosure there is a method of exercise providing two supported pivoting arms each with a grip attached and each connected to the base with a pivot and a rotating hub attached to each pivot wherein each hub has a magnetically attractive region thereon and each pivoting arm is movable around 360 degrees (Each hub is attached to each pivot such that each hub rotation corresponds to arm movement). The method includes providing a movable magnetic device in close proximity to each hub wherein moving the magnetic device will vary the magnetic field being applied to the hub and placing a user between the bases and having the user grasp the grips. The user moves the grips around a guided circular pathway and the magnetic field is varied at least once during movement of the arms around a revolution.

In some aspects of the method the variation of the magnetic field is determined at least in part from action data in a LUT. In some aspects the variation of the magnetic field is determined at least in part from sensor data provided from machine readable data measuring action data during exercise. In some aspects the variation of the magnetic field is determined at least in part from physical state data provided from one or more physical state sensors. In some aspects the LUT is constructed at least in part from a user test.

The present disclosure is a circular motion exercise device using a circular motion exercise device and method whereby the resistance being exercised against is varied during movement around a circular pathway. Circular movements tend to be non-jarring. A user positioned between two generally opposite grips on movable members (arms or other guides) pivotally attached to a support or base moves the grips about a limited route of travel around a 360 degree circle.

The arms or guides provide for grip movement in front of the user, to the sides of the user's torso and behind the user's front. This grip movement encourages the movement of the user's arms, torso and shoulders. Such movement when extending towards a user's torso sides and behind the user's front can also encourage use of the user's abdominal muscles.

In some exemplary implementations the supports are generally placed opposing each other. The opposing relationship of the members providing for the circular exercise movement need not be parallel and may be variable, fixed or adjustable.

In some exemplary implementations a user's hands each hold a handgrip. The movement of the grip around a pivot, guided through a generally circular or elliptical movement, also may direct the user's body to move up and down, side to side or both up and down and side to side. A guide associated with each grip provides for the guided movement of the grip. The guide may be a wheel, arm, lever or other movable member, the grip is guided. Resistance against which a user can exercises is added to increase the work a user must do to push the grips and guides around the pivots through the circle.

The work which a given group of targeted muscles exerts can be expressed in terms of force. In general terms when the resistance to movement of the pivot is increased the force a user must apply to move the movable members on pivots also increases. The increase in the force the user must apply to move the movable member against resistance can help build a user's strength. The application of force also requires work which in turn may help a user burn Calories.

The present disclosure provides a device and method to vary forces being exercised against around the 360 degrees of movement. By varying or "fine tuning" the resistance being worked against as different groups of muscles are engaged to provide the forces to move the load around the pivot the appropriate magnitude load is being applied to the muscles or groups of muscles at the right time during the exercise.

The present disclosure provides a device and method to vary forces being exercised against around the 360 degrees of movement. By varying or "fine tuning" the resistance being worked against as different groups of muscles are engaged to provide the forces to move the load around the pivot the appropriate magnitude load is being applied to the muscles or groups of muscles at the right time during the exercise and in some aspects that load may be varied over one of time, distance and position.

In some exemplary implementations the dynamic variable frictionless resistance is provided via magnets. The movable magnet body interacts with a region on a hub or wheel connected to the guide and support is adjustable via a positional means such as a motor. In some aspects a sensor monitors the position of the hub or wheel, via machine readable data corresponding at least one of to hub, arm, grip, user and wheel position and provides the data to the controller and/or processing unit.

In some exemplary implementations the dynamic variable frictionless resistance is provided via magnets. The movable magnet body that interacts with a region on a hub or wheel connected to the guide and support is adjustable via a moving means. A sensor monitors the direction of movement, position of the hand grips, hub and/or wheel, via machine readable data corresponding to position and direction which is processed by a controller and/or processing unit that adjusts the position of the magnet body to adjust the magnetic force applied for a direction, time and/or position corresponding to a zone or portion of a zone.

Other features and advantages of the present disclosure will be set forth, in part, in the descriptions which follow and the accompanying drawings, wherein the implementations of the present disclosure are described and shown, and in part, will become apparent to those skilled in the art upon examination of the following detailed description taken in conjunction with the accompanying drawings or may be learned by practice of the present disclosure. The advantages of the present disclosure may be realized and attained by means of the instrumentalities and combinations particularly pointed out in the appended claims.

BRIEF DESCRIPTION OF THE DRAWINGS

FIG. 1E is a top view of the embodiment of FIG. 1A.

Figure 1A:
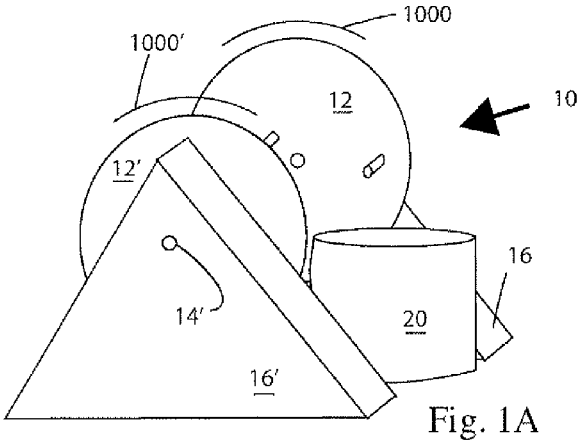
FIG. 1A is a perspective view of an embodiment of the dual circling exercise device.
Figure 1B:
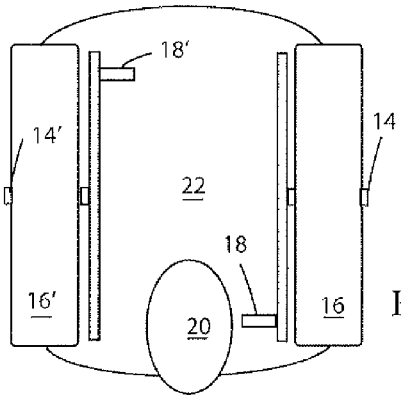
FIG. 1B is a top view of the embodiment of FIG. 1A.
Figure 1C:
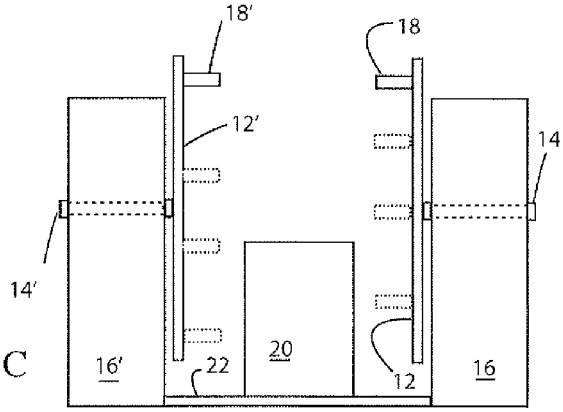
FIG. 1C is a front view of the embodiment of FIG. 1A.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION

Shown in FIGS. 1A-1E is a dual circling exercise device 10. A pair of guides shown as rotatable wheel elements 12 & 12' are affixed, generally opposite one another, each to a spindle support 14 & 14'. The wheel elements need not be parallel. Each rotatable wheel element 12 & 12' is pivotally fixed to a support. In the implantation shown in FIGS. 1A-1E the support is a side base 16 & 16'. Each rotatable wheel element 12 & 12' may also be weighted. The weighting may be evenly distributed around the wheel or distributed unevenly. A hand grip 18 & 18' is affixed to each rotatable wheel element 12 & 12'. During use each hand grip is held by a user 100 in the user's hands 102. To exercise with the device a user moves or "drives" each handle around at least an arc which is part of a generally circular pathway 1000 & 1000' around each pivot 14 & 14'. The circular pathways 1000 & 1000' are generally in the same plane. The user may move the handles together or separately. The user may move the handles clockwise or counterclockwise or one in each direction. The user can make slow movements or may use the device for a more aerobic workout by repeatedly circling the grips around the pivots on each side.

The user may grip the handles palm down or palm up. Those skilled in the art will recognize that grips shown as handles generally perpendicular to the rotatable wheel element 12 & 12', may be replaced with angled grips.

The hand grips may be fixed to the rotatable wheel element 12 & 12' guides. It is preferred that the grips can freely rotate where attached to the rotatable wheel element 12 & 12'. The user's arm and hand movements, as shown in FIGS. 1D & 1E drive the wheel element 12' along the line of arrow 1000 around the spindle 14'. The spindle 14' acts as a pivot. Only one wheel element is shown in the side view of FIGS. 1D & 1E, this is not a limitation the second wheel element is also being rotated as indicated by the movement of the back arm 104.

Figure 1D:
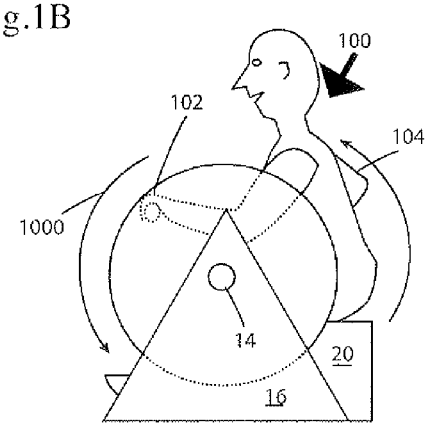
FIGS. 1D and 1E are side sequential views of the a method of use of the embodiment of FIG. 1A.
Figure 1E:
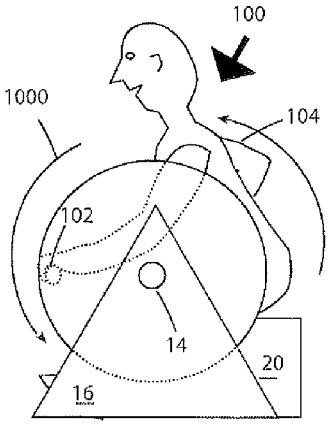
Figure 1F:
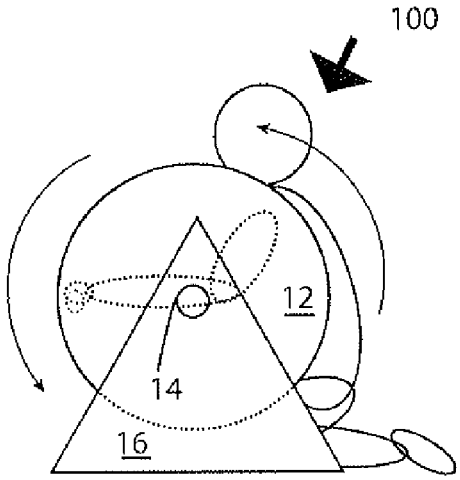
FIG. 1F is a side view of the kneel use of the embodiment of FIG. 1A.
Figure 1G:
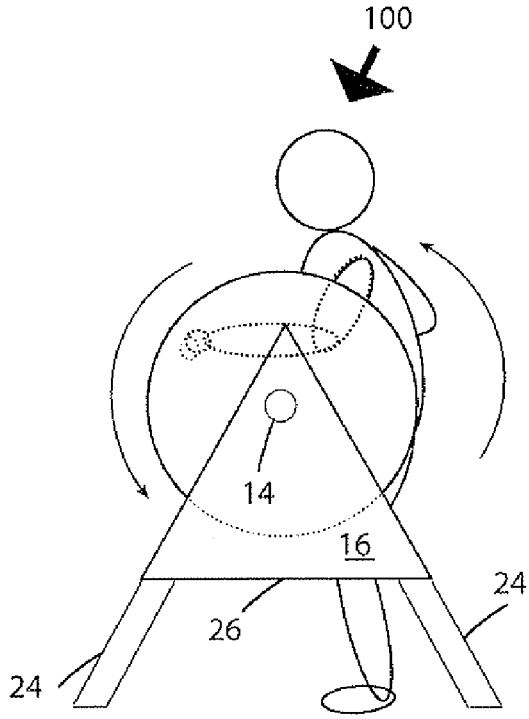
FIG. 1G is a side view of an alternate stand up embodiment of the dual circling exercise device.
Figure 1H:
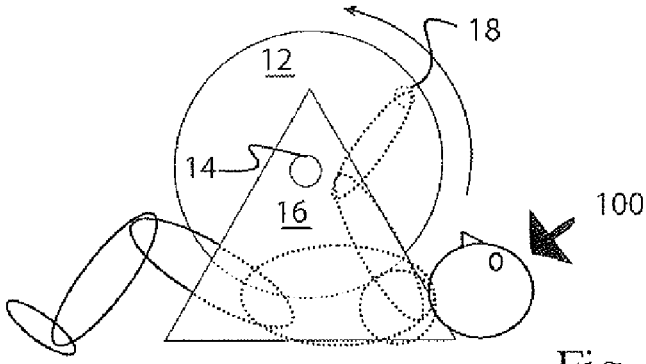
FIG. 1H is a side view of an alternate lie down embodiment of the dual circling exercise device.

The user 100 can sit on a seat 20 as shown in FIGS. 1D and 1E, kneeling as shown in FIG. 1F, stand as shown in the embodiment of FIG. 1G or lie down as shown in FIG. 1H. The seat may be connected to, or rest on, a base 22. To raise the side base 16 leg lifts 24 are attached to the bottom 26 of the side base 16.

Figure 2:
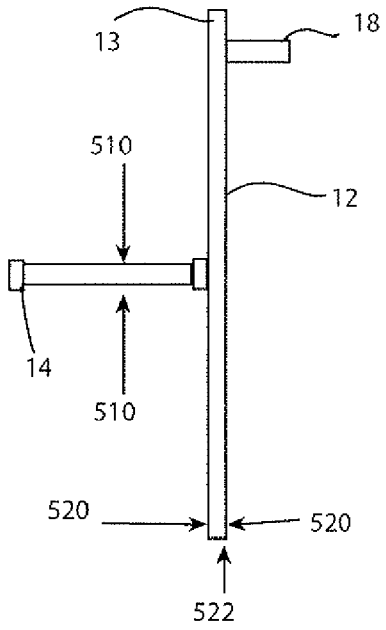
FIG. 2 is force application diagram of a circling wheel element.

Shown in FIG. 2 is a force diagram of a rotatable wheel element 12 showing regions where force may be applied. A braking or resistive force, frictional, frictionless may be applied to the spindle 14 along the lines, generally, of arrow 510. A braking or resistive force, frictional, frictionless may be applied to the edge 13 of the rotatable wheel element 12 along the line of arrows 520. A braking or resistive force, frictional, frictionless may be applied to the edge 13 of the rotatable wheel element 12 along the line of arrow 522. The rotatable wheel element 12 may also be weighted, separately or in addition to the application a braking or resistive force. Those skilled in the are will recognize that the force diagram is applicable to other types of guides and the rotatable wheel elements are not a limitation.

Figure 3:
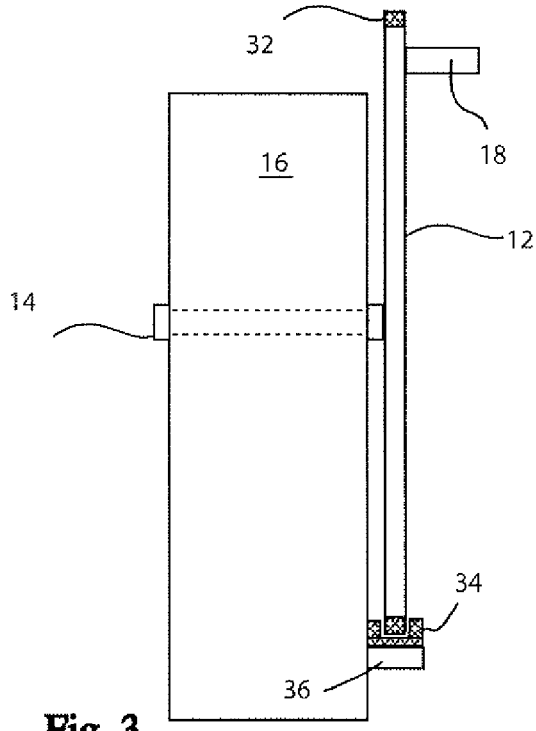
FIG. 3 is a partial view of a circling wheel element with magnetic resistance.

FIG. 3 shows the application of a magnetic force at the edge 13 of the rotatable wheel element 12. At the edge of the rotatable wheel element 12 a magnetic region 32 is provided. The magnetic region 32 may be magnetized metal or a material attractive to magnetic forces. A magnet 34 is connected to the device (at the side base) in either a fixed or adjustable fashion in close proximity to the magnetic region 32. In FIG. 3 the position of the magnet 34 is adjustable. Moving the magnet in relationship to the magnetic region 32 varies the magnetic force applied to the magnetic region 32. The magnet rests on a movable base 36. One or more magnets 34 may be placed around the rotatable wheel element 12. Magnetic force is without friction.

Figure 4:
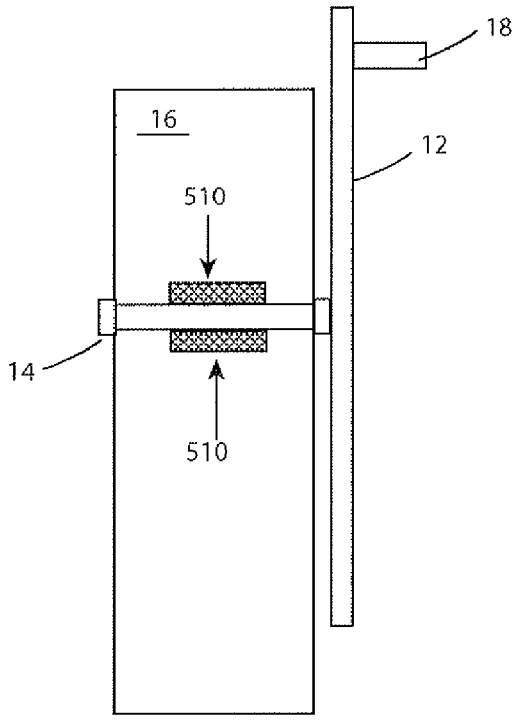
FIG. 4 is a partial view of a circling wheel element with friction resistance.

Shown in FIG. 4 is a friction brake or clutch engaged at the spindle 14 whereby friction is applied to the spindle 14 along the line of arrow 510 to provide a resistive force. A spindle can be a shaft or rod no particular material is called out for, however the material should be suitable to withstand repeated application of frictional forces applied by brakes or clutches.

Figure 5:
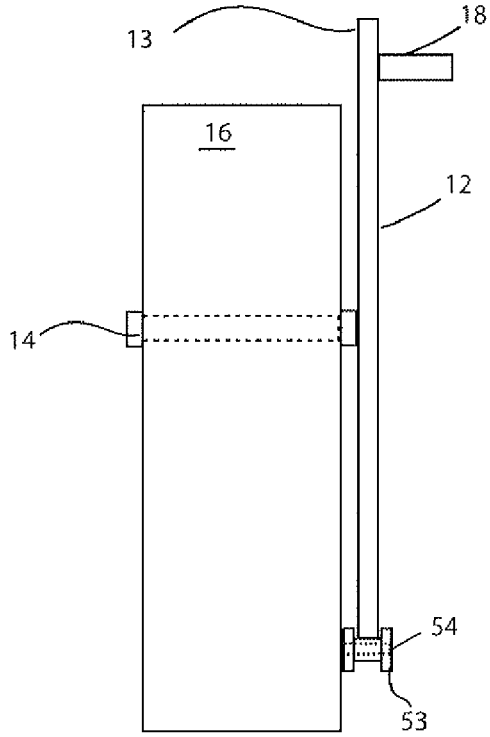
FIG. 5 is another partial view of a circling wheel element with friction resistance.

Shown in FIG. 5 is a friction roller 53 on a roller spindle 54 which is pressed against the edge 13 of the rotatable wheel element 12 to provide a resistive force. One or more rollers 53 may be placed around a rotatable wheel element 12.

Figure 6A:
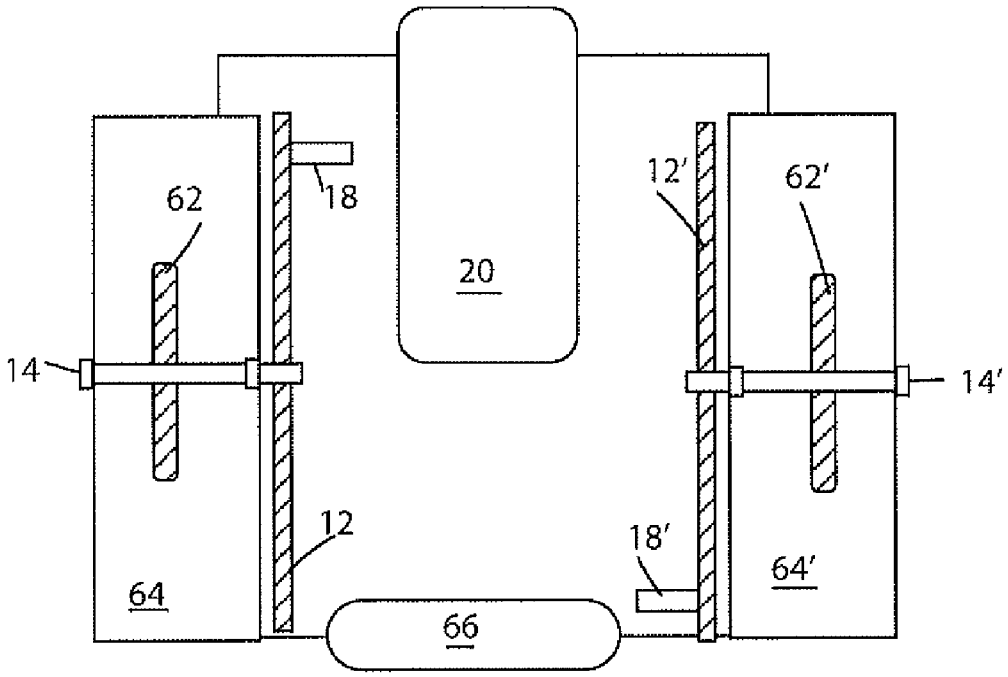
FIG. 6A is an another embodiment of the exercise device.
Figure 6B:
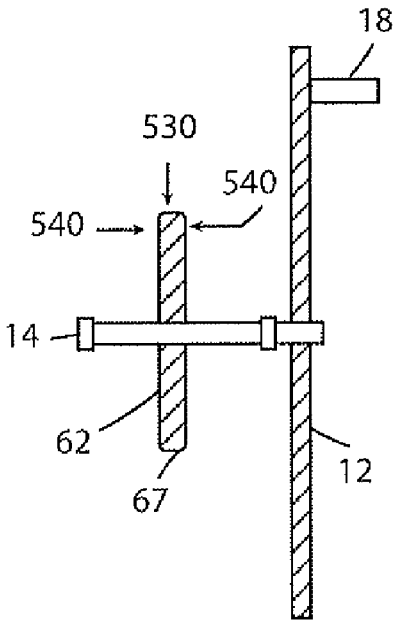
FIG. 6B is force application diagram of a circling wheel element with circling disk.

FIGS. 6A and 6B differs from FIG. 1A by the attachment of a rotating disk 62 & 62' affixed to each spindle 14 & 14' inside the interior of each side base 64 and 64'. A foot rest 66 is also provided.

Shown in FIG. 6B is a magnetic or frictional force diagram of a rotating disk 62 and rotatable wheel element 12 showing regions where force may be applied to the rotating disk 62. A force may be applied to the edge 67 of the rotating disk 62 along the line of arrow 530. A magnetic or frictional force may be applied to the edge 67 of the rotating disk 62 along the line of arrows 540. The rotating disk 62 may also be weighted.

Figure 7:
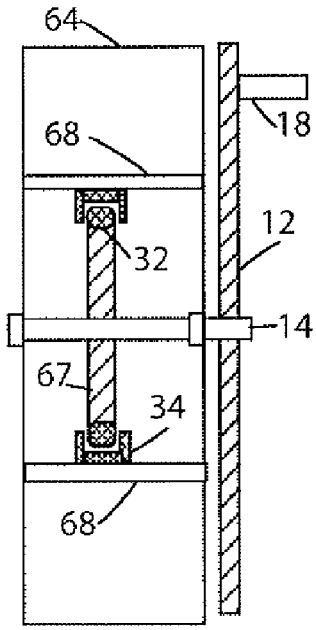
FIG. 7 is a partial view of a circling wheel element and circling disk with magnetic resistance.

Shown in FIG. 7 shows the application of a magnetic force at the edge 67 of the rotating disk 62. At the edge of the rotating disk 62 a magnetic region 32 is provided. The magnetic region 32 may be a magnetized metal or a material attractive to magnetic forces. A magnet 34 is affixed to the device (in the side base) in close proximity to the magnetic region 32. In FIG. 7 the magnet 34 is resting on a movable base 68. One or more magnets 34 may be placed around the rotating disk 62.

Figure 8A:
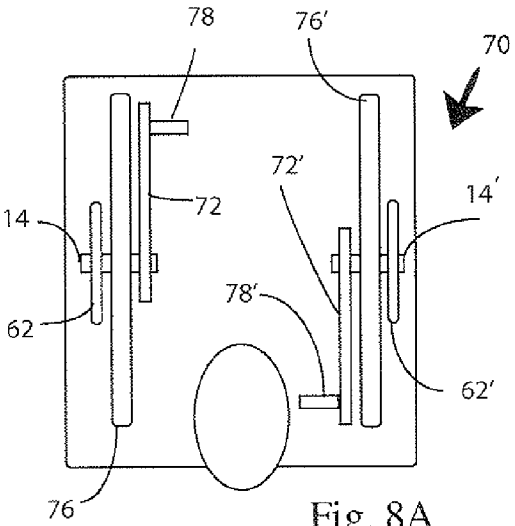
FIGS. 8A-8C are an another embodiment of the exercise device.
Figure 8B:
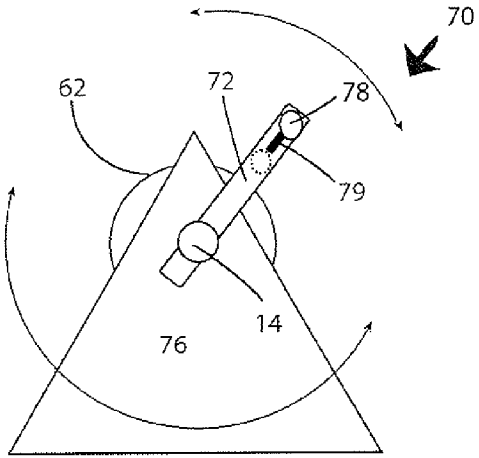
Figure 8C:
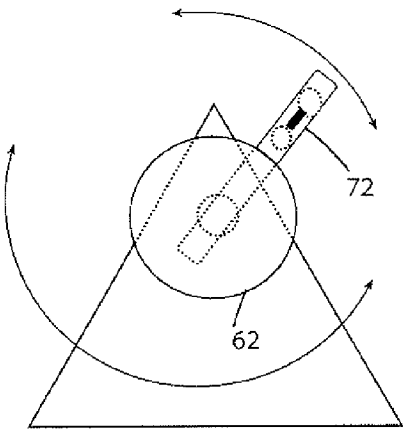

Shown in FIGS. 8A-8C is a dual rotating exercise device 70 wherein the guides are extended arms 72 & 72'. In this exemplary implementation the arms 72 & 72' are connected to rotating disks. A pair of rotating disks 62 & 62' are affixed, generally opposite one another, each to a spindle support 14 & 14', to a side base 76 & 76'. Each rotating disk 62 & 62' may also be weighted. A movable hand grip 78 & 78' is affixed movably to each arm 72 & 72'. A slot 79 in each arm 72 & 72' allows the hand grip 78 & 78' to slide in relation to the spindle 14 and 14'. The spindle is the pivot point. Altering the distance of a hand grip to a pivot point changes the distance the users hand, arm and body are guided through when rotating an arm around the spindle 14. The change in position of the hand grip also changes the force required to move the arm.

Figure 9:
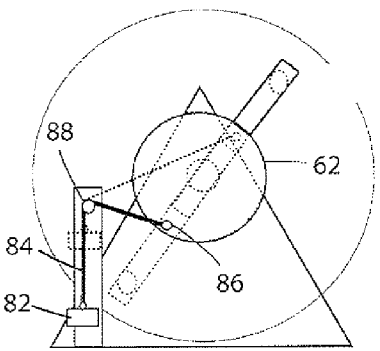
FIG. 9 is an alternate embodiment of the embodiment shown in FIG. 8A with movable weight.

Shown in FIG. 9 is a side view of an exemplary implementation, with a lifting weight added. The embodiment shown in FIG. 9 operates similarly to the embodiments shown in FIGS. 8A-8C, however a weight 82, which may be a fixed amount or adjustable, is attached to the rotating disk 62. The weight 82 is held on a cable 84 which attaches to a cable mount 86 on the rotating disk 62. the cable is suspended from a cable guide 88. The weight travels up and down below the guide 88 corresponding to the movement of the rotating disk 62.

Figure 10B:
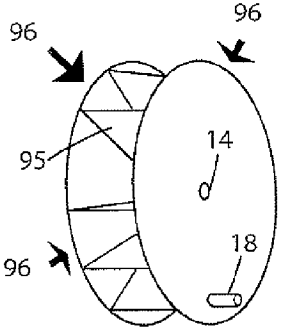
FIGS. 10A and 10B are partial views of a circling wheel element with air pressure resistance.
Figure 10A:
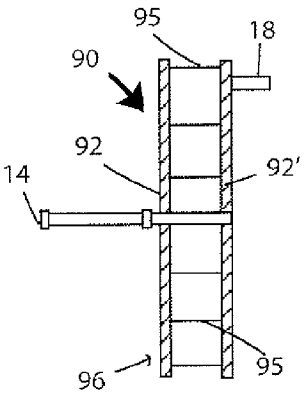

Shown in FIGS. 10A and 10B is a rotatable fan wheel element 90. Each fan wheel element 90 is constructed of two side wheels 92 & 92'. Spaced between the side wheels 92 & 92' are fan blades 95 which extend from the pivot 14 to the periphery 96 of the fan wheel element. When a fan wheel element turns around the pivot 14 when the user engages the hand grip 18. The movement of the fan blades 95 through the air creates resistance against the fan blades 95.

Figure 11B:
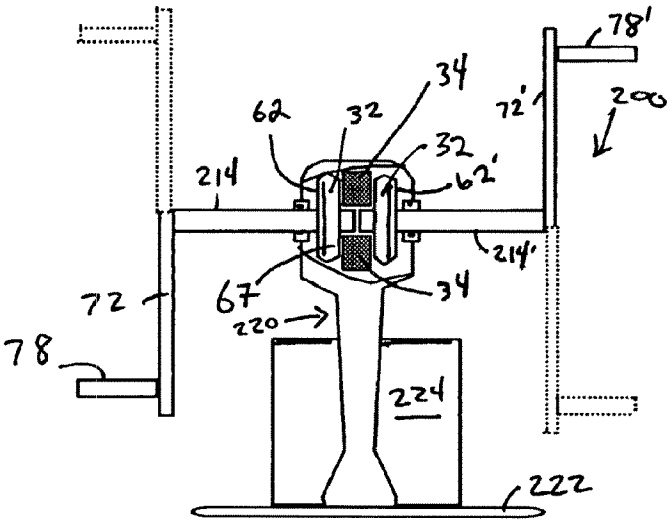
FIGS. 11A and 11B show another embodiment of the exercise device with magnetic resistance
Figure 11A:
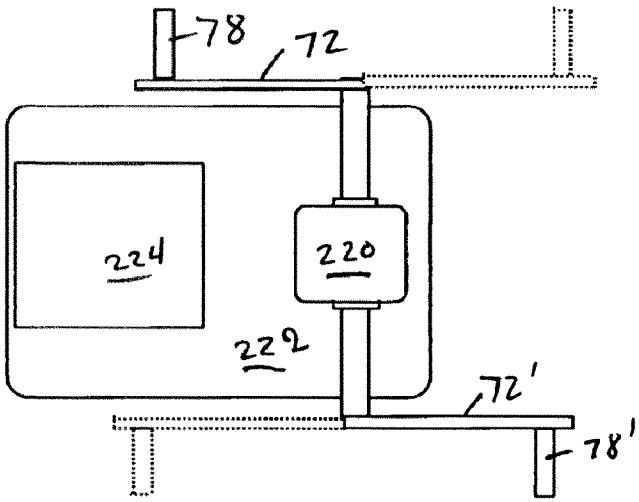

Shown in FIGS. 11A-11B is a dual rotating exercise device 200 wherein the guides are extended arms 72 & 72'. In this exemplary implementation the arms 72 & 72' are connected to rotating disks 62 & 62'. The rotating disks 62 & 62' are affixed, generally opposite one another, each to an elongated spindle support 214 & 214' which is movably fixed to a central support 220, which is affixed to a base 222. Each rotating disk 62 & 62' may also be weighted. A movable hand grip 78 & 78' is affixed movably to each arm 72 & 72'. A slot in each arm 72 & 72' (shown in FIGS. 8A-C) allows the hand grip 78 & 78' to slide. Each elongated spindle is the pivot point. Altering the distance of a hand grip to a pivot point changes the distance the users hand, arm and body are guided through when rotating an arm around the spindle 214 & 214'. The change in position of the hand grip also changes the force required to move the arm. A seat 224 is shown for the user to sit on.

Resistance in some implementations can be increased by the application of a magnetic force at the edge 67 of the rotating disk 62. At the edge of each rotating disk 62 a magnetic region 32 is provided. The magnetic region 32 may be a magnetized metal or a material attractive to magnetic forces. One or more magnets 34 are affixed to the device in close proximity to each magnetic region 32.

Figure 12:
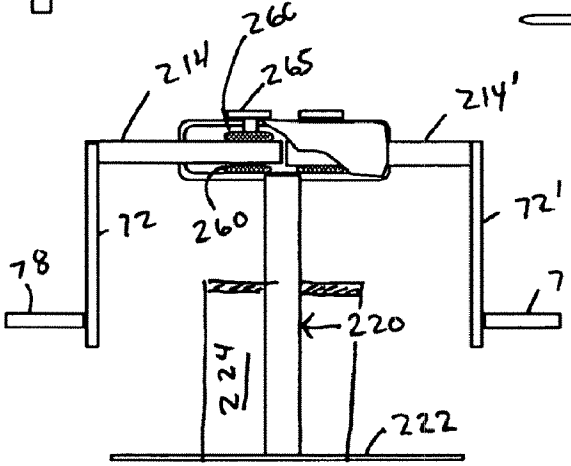
FIG. 12 shows an embodiment of the exercise device with friction resistance.

Shown in FIG. 12 is an exemplary implementation 250 with a friction brake 260 at the spindles 214 & 214' whereby friction is applied to the spindles 214 & 214' to provide a resistive force. Increasing the pressure of the friction brake 260 provides a greater force to rotate the spindles 214 & 214' against. A screw-type handle 265 connected to each friction brake is shown.

Figure 14:
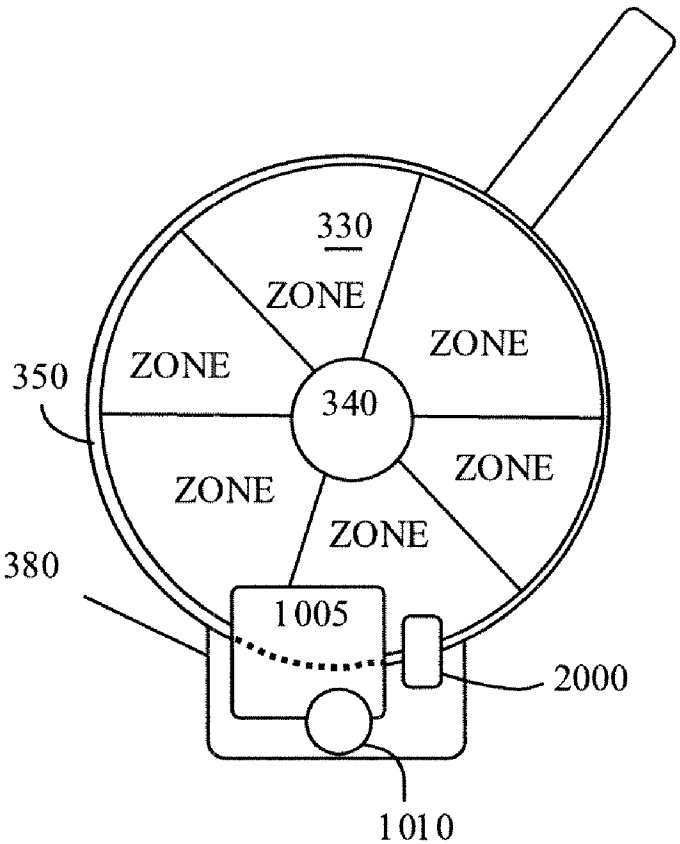
FIG. 14 is a side view of one side of a dynamic variable dual circling exercise device with magnetic hub.
Figure 13:
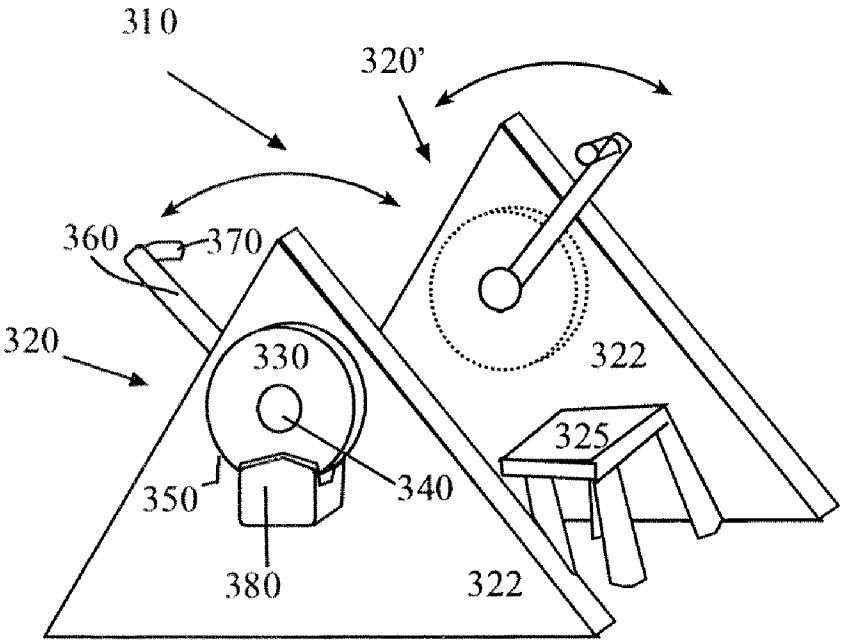
FIG. 13 is a perspective view of a dynamic variable dual circling exercise device with magnetic hub.
Figure 15:
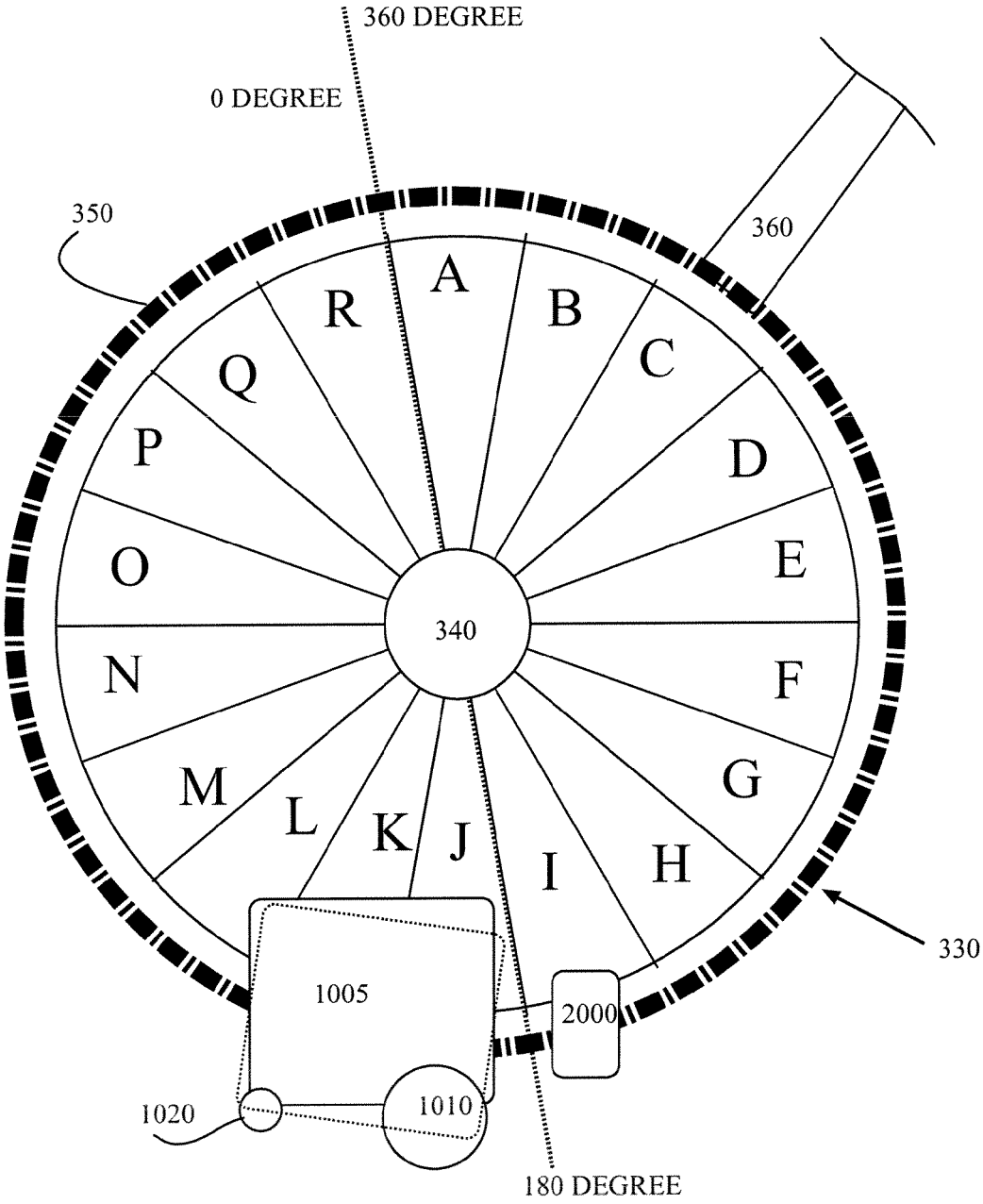
FIG. 15 is a partial component side view of a frictionless magnetic resistance system for a dynamic variable dual circling exercise device.

Shown in FIGS. 13-15 and TABLE 1 are exemplary implementations of devices and methods of exercise using dynamic dual circling variable resistance. The device 310 shown in FIG. 13 is comprised of two mirror image sides 320 and 320' which may or may not be connect to one another.

Each side provides a base (which is a support structure) 322 that at least supports a rotatable hub 330 which movably connected to a pivot 340. The base, or additional elements attached thereto may also be used to orient, adjust and position the hub 330 and/or pivot 340. Each hub is constructed, at least in part, of a material which is attractive to magnetic forces 350 shown in FIG. 13-15 as a surrounding edge. A pivoting arm 360 (which may also be referred to as a rotating arm) with a handle or handgrip 370 is connected to each rotatable hub 330 and or the pivot 340. The pivot can be connected to the support (such as the base) to steady it during rotation and to the hub 330 and the rotating arm 360. Each rotating arm 360 is placed opposite one another. The rotating hub is attached to each pivot 340 wherein each hub rotation corresponds to arm movement. A magnetic resistance assembly 380, which contains a magnetic device 1000, a moving means 1010 and a sensor 2000, is supported on each base 322. The magnetic device 1005 within the assembly is positioned to magnetically interact with the material attractive to magnetic forces 350 on each hub. The magnetic interaction is by way of magnetic fields produced by each magnetic device. In some exemplary implementations affixed to, around, or otherwise associated with each hub, arm 360 and/or handgrip 370 is be machine-readable data points which at least may be read to provide one or more of position, speed, direction.

The arms 360 or other movable elements supporting the handgrips 370 need not be parallel. The handgrips 370 are used to spin the hub 330 about the pivot 340. The arms 360 and hub 330 may be connected to a common pivot 340. The magnetic resistance assembly 380 provides resistance to that movement. To exercise with the device a user moves or "drives" each arm around at least a partial arc which is part of a generally circular pathway around each pivot 340 (a revolution is a 360 degree movement around a pivot). The user may move the handles together or separately. The user may move the handles clockwise or counterclockwise or one in each direction. The user can make slow movements or may use the device for a more aerobic workout by repeatedly circling the grips around the pivots on each side. The user may grip the handles palm down or palm up. Those skilled in the art will recognize that grips shown as handles generally perpendicular to the hubs, may be replaced with angled or movable grips.

The hub 330 as shown in FIGS. 14-15 is shown divided into zones. The zones represent the 360 degrees (a revolution) around the hub. Components of the magnetic resistance assembly 380 are magnetic device 1005; at least one moving means 1010 which may include an electric motor and one or more of an armature, lever, gear, wheel, stepper motor, screw and the like. Optionally a separate magnetic device pivot 1020 may be added. The moving means is sufficient to adjust the position of the magnet device 1005 relative to the hub at least once per revolution and preferably multiple times per revolution. The magnetic field applied to the hub is distance specific. The magnetic filed drops off by the cube of the distance from the region of the hub attractive to magnetic forces. Accordingly small movements of the magnetic device 1005 relative to the region of the hub 330 responsive to magnetic forces 350 results in significant changes to the resistance at or about the hub.

A sensor unit 2000 may be near the hub 330 to monitor, read, provide, translate and/or process machine-readable data "MRD" (associated with each zone). Positional, optical, RF and impact (pressure) sensors are all well known in the art. The sensor unit may also be remote. "MRD" may include color, texture, glyphs, composite, bar codes, space magnets, IR tags, RF tags, and the like which provide data points associated with hub/arm position that can be converted into speed, distance, rate, direction and position data corresponding to arm/grip position corresponding to the hub/zone position associated with the magnetic resistance assembly 380. For example the grips may be at position zone "C" while the hub is at position zone "K" relative to the magnetic resistance assembly 380 (See generally FIG. 15).

At least the moving means 1010 and the sensor unit have switching and/or power connections. The sensor unit 2000 also has a data connection whereby the sensor unit 2000 can supply data which may be all or a subset of the MRD to a controller and/or a data processing unit (not shown). The function of the data processing unit is to process the data provided regarding at least one of hub zone speed, distance, rate, direction, and position during a single rotation of the hub.

The controller (not shown) is a unit that is associated with or acts as a moving means to adjust the position of the magnetic device. A controller may receive data directly from a data source such as a sensor and/or it may receive instructions/data from a processor such as a computer or microprocessor. A controller may be a gyroscope, an electromagnet, a motor controller that can adjust the speed of a motor, or it may turn screw, adjust a stepper motor, alter the force on a lever, adjust the turns of a gear and the like, such positional adjustment controllers are well known in the art and there are a vast variety of moving means for the magnetic device and/or assembly each of which may have its own controller to effectuate the alteration of the position of the magnetic device.

The data processing device may also be used to provide instructions to selectively adjust the moving means 1010 whereby the position of the magnet assembly 1005 relative to the hub/zones is altered. The movement of the magnet assembly 1005 changes the magnetic forces applied at a selected hub/zone positions during a movement within a single revolution of rotation thereby adjusting the forces exercised against. While a single data processing unit for receiving sensor data is discussed, that discussion is not a limitation and any number of processing units may be added. While a single moving means for each magnetic device is discussed, that discussion is not a limitation and any number of moving means may be added.

Further, the sensor unit may be remote, wired or wireless. Wireless communication may be through any wireless communication protocol including but not limited to WIFI and bluetooth. Moreover, the sensor unit 2000 may be a part of a machine vision system, be a motion or impact sensor (such that small raised bumps on the hub (not shown) may be provided to strike the sensor during movement). The sensor may also communicate (with wires or wirelessly) the action data to a peripheral device such as an ipod™, mp3 player, video player, display, cell phone, laptop and the like.

Figure 16:
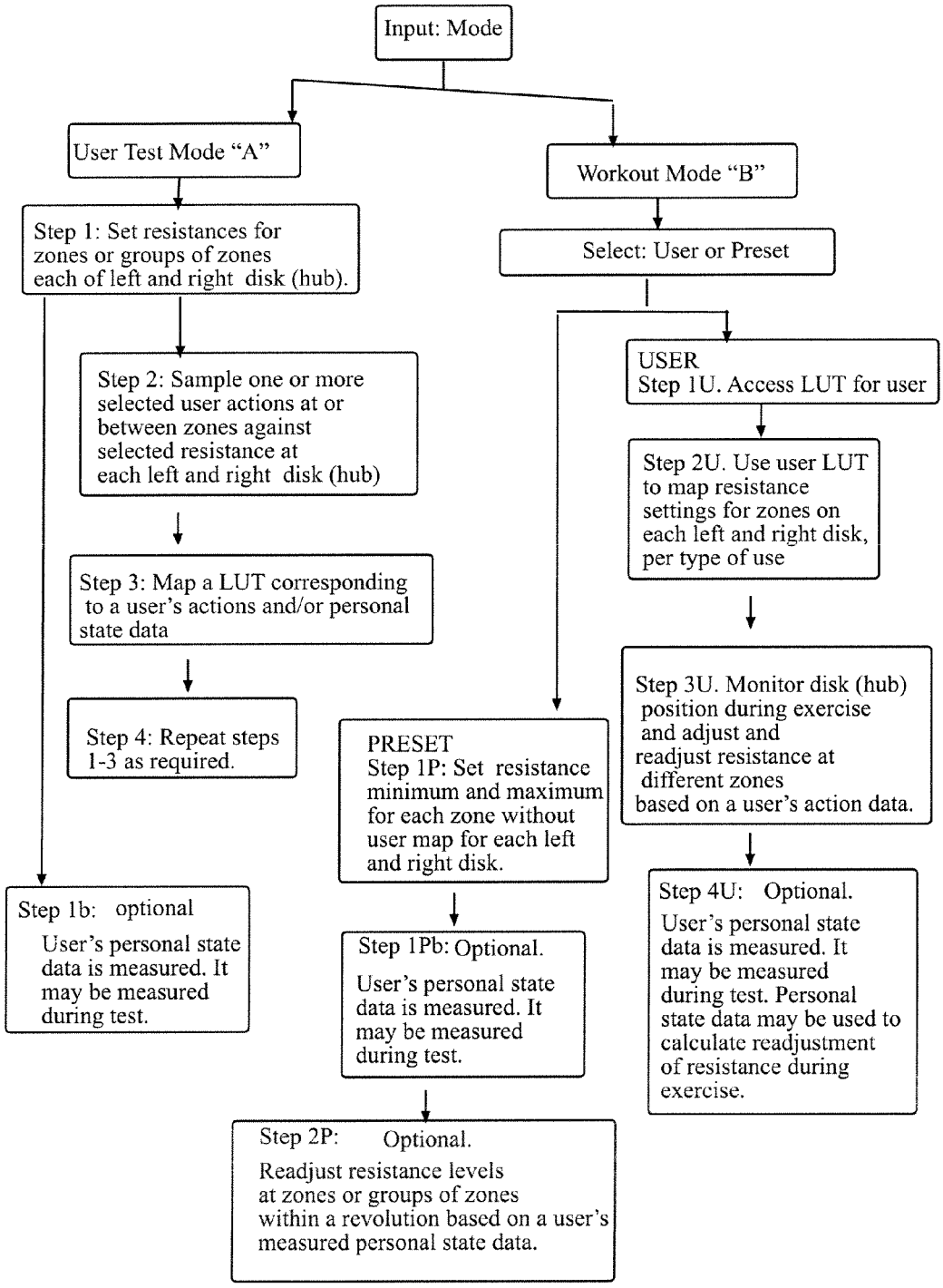
FIG. 16 is a flow chart showing modes of use and adjustment of a dynamic variable dual circling exercise device.

FIG. 16 is a simplified flow diagram of steps a processor can apply to build a look up table LUT and/or adjust the resistance of the device during one or more rotations, through testing and exercise which may include multiple revolutions (rotations).

Action Data:

To begin a user selects a mode. The mode "User Test" instructs the processor to set a fix resistance between the magnet assembly 380 and the hub 330. The user then rotates the handgrips 370 and connected arms 360 around the pivot 340, thereby moving the hub 330 (also referred to as a disk) a pre-determined number of times (revolutions) at the first fixed resistance. The user actions provides data corresponding to the user's use of the device and specifically to the user's movements of the rotating arms about the pivot. That action data may include speed, distance, direction, time acceleration, counter-force applied. The action data provided during user test or during workout may be provided to one or more processors.

The one or more processors at least operate to set a second fixed resistance and repeat the testing providing additional. The test process may be repeated to construct a user profile which contains target values for resistance settings during exercise through zones or groups of zones over time.

A user's action data in its simplest form is a measurement of one variable such as the time between zones passing the sensor. Additional variables may also be monitored including but not limited to direction the zones are moving, difference of rates when the two hubs are moving together (with zones substantially aligned, i.e. zone "A" of the left hub and zone "A" of the right hub pass the sensor at about the same time) as opposed to when the two zones are staggered (when zone A left hub passes the sensor and not zone "A" right hub passes the sensor at about the same time). Further difference between rates when the stagger is zone a left and zone "B" right as opposed to zone "A" left and each of zone "A-R" right all may be monitored. In some instances the distance, position, rate and other data for select groups of contiguous zones may be monitored.

For different exercises, the action data for different test can be used. For target muscle groups in the chest, handgrips may be moved in an arc together (not staggered). To adjust the resistance within the zones for each of the left "L" and right "R" sides of the device and the zones thereon that will pass the magnet resistance assemblies 380 during such an exercise the LUT(s) corresponding to the hands together not staggered test(s) may be appropriate. For different groups of targeted muscles such as shoulder muscle groups, the handgrips may be rotated one side forward and one side backward, hand positions may be up or down. To adjust the resistance within the zones that will pass the magnet resistance assembly 380 during such an exercise the LUT for the forward turning side and the LUT for the backward turning side can provide data for adjustment of the resistance.

The action data can be mapped to construct a user specific LUT which can supply target values for resistance though a zone or zones over time. Because different muscle groups may have different strength or a user may have a weaker group or injury and the LUT constructed from the "User Test" should reflect the time between zones at different resistances, directions and under different loads, such data may be used to at least:

Identify a maximum resistance to be applied to a zone during a particular exercise or movement.

Adjust the resistance between zones during exercise.

Adjust the resistance at the left and right hubs corresponding to maximum settings for particular dual zone movements of the hubs.

Action data measured via the MRD can be supplied to a controller or processor during exercise to provide data which can be sued to vary the magnetic field via the magnetic resistance assembly during exercise.

Those of ordinary skill in the art will recognize that adjusting the resistance at the hubs also adjusts the resistance at the pivot, arms and or grips and whether the adjustment is measured at the hubs, pivot, arms or grips such is within the scope of this disclosure.

Physical State Data:

Physical state sensors "PSS" may also be added (See FIG. 16). PSS are known in the art. PSS's can be used to measure or monitor physical attributes of a user during, before or after use of the device. A non-exclusive list of such attributes include temperature, pulse, brain wave, oxygen saturation, and blood pressure. The PSS may be used to provide personal state data (the physical state of a person) on the above attributes. Personal state data from the PSS can be used to derive a baseline before a User Test or before any given workout. Personal state data from the PSS can be used to monitor recovery time and/or physical state during different levels of activity. PSS can be used to monitor target physical states such as heart rate, blood pressure, temperature and oxygen saturation. PSS data may be correlated to the user's action data which may be used to "fine tune" resistance setting to both the user's measured maximum force output per muscle grouping (action data) and the user's physical state during such exercise. For example in some instances resistance my be reduced or increased based on personal state data to below or above the target level for the resistance over a zone or zones.

The personal state data may be mapped and included in a user specific LUT. Physical condition of a user may vary with stress, fatigue, health, diet, time of day, disease or a variety of other factors. The measurement and/or monitoring of physical state may be useful to scale down or up the resistance to adapt to a user's condition in lieu of or in addition to the user's action data.

At various time intervals (minutes, hours, days, weeks, months etc.) the user test may be repeated to modify the user profile and/or create additional user LUTs/profiles. Multiple profiles may be used to track a user's progress in terms of the action data and/or the personal state data. Personal state data and the action data can be provided to the data processing unit (s). The user test may also include directions to the user to rotate the handgrips and arms backwards. The user test may also instruct the user to stagger the handgrips and arm rotating them accordingly or rotate only one arm.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The LUT

FIG. 16 provides a flow chart a basic steps for a User Test and a Workout. Optional steps are also identified. A user test is a set of steps to determine resistance setting for each of the left and rights sides of the device for directional movements through different zones by a user.

The use of a device, system and/or the method of exercise, begins with a user input. The user selects either user test "A" mode or workout "B" mode.

If user test mode is selected a user test starts. For a user test the following steps take place:

Step 1: Setting of a first fixed resistance by moving the magnetic device 1005 to a position near to the material attractive to magnetic forces 350 on the edge of the hub, the relative positions of the magnetic device 1005 to the material attractive to magnetic forces 350 corresponds to a resistive force applied to the hub.

Step 1b: Optional step wherein a user's personal state data may also be measured with PSS as previously described and that personal state data may be used as a value when developing the LUT.

Step 2: Sampling user actions. During this step a user exercises through a series of one or more revolutions per left side and per right side and the exercise is sampled between zones, groups of zones and revolutions. The movements may be in one or more directions and with grips either together or staggered and/or partial revolutions. The sensors units 2000 for each of the right and the left sides supply MRD corresponding to a user's action data such as time between zone "A" and zone "B", time between zone "A" and zone "C", time from zone "A-R" forward direction and/or time between zone "R-A" backward direction, time between a first and last revolution and total time to complete a first revolution versus total time to complete a subsequent revolution.

Step 3: Mapping a user's actions by way of the MRD supplied to a processor. The MRD when processed provides information to construct a LUT including hub, rotating arm and/or grip position, speed, distance, acceleration, and time of exercise. The resistive force applied in Step 1 combined with the MRD is used to calculate forces to be applied at selected zones corresponding to an exercise algorithm such as: apply sufficient resistance to the hub so that the user's time to pass the hub rotation from groups of zones X-Y (where X and Y are known quantities) does not exceed time Z, or for that for exercise exceeding a predetermined distance or time reduce the resistance at each zone be within the revolution a selected percentage. Information which may be calculated from the MRD includes but is not limited to: distance (D) over resistance (R) which may be described by the formula (D/R). Acceleration (A) though one or more zones ($z\text{-}z^{\pm n}$) over resistance which may be described by the formula ($A\ z\text{-}z^{\pm n}/R$). Distance over time (t) at a first set of selected resistances and at additional selected resistances ($r\text{-}r^{\pm n}$)which may be described by the formula $D/t(r\text{-}r^{\pm n})$.

Step 4: Repeat steps 1-3 to measure the user at various resistance levels to construct the LUT. Repeats may include forward rotation, backward rotation, staggered or not staggered grips. Repeats may include a predefined number of revolutions as an endpoint. Repeats may include a predefined distance as an endpoint.

If workout mode is selected the workout mode begins with a selection of "User" or "Preset". If "User" is selected and a LUT for user is available go through Steps 1U-4U. If Preset is used go through Steps 1P-2P.

In Preset the following steps take place:

Step 1P: Set a minimum and maximum resistance for each zone for each of the left and right disks (sides).

Step 1Pb: Optional step is to measure the personal state data of the person exercising, if PSS are available.

Step 2P: Optional step whereby one or more resistance levels may be adjusted during the exercise based on user personal state data during use. This optional step is predictive and adaptive and similar to attempting to construct a user LUT during use.

If "User" is selected the steps are as follows:

Step 1U: Access a user's LUT.

Step 1Ub: Optional step measure a user's personal state data values and to adjust the LUT to reflect alteration in minimum and/or maximum resistance setting for zones or groups of zones based on the current personal state data measured.

Step 2U: Adjust the resistance settings on each of the left and right side to reflect at least the LUT settings.

Step 3U: Measure/monitor hub positions (positions of each zone over time) during exercise and adjust and readjust resistance at different zones to better match resistance levels to predetermined targets of time, distance and/or acceleration through zones or groups of zones. For example if based on the LUT a target time between each zone or group of zones is determined and the user's movement taking too long to pass between zones, the resistance may be decreased. Conversely if user is passing the hub too quickly (based on time targets) through a zone or zones the resistance may be increased.

Step 4U: Optional, continue to monitor a user's personal state data values and adjust resistance accordingly. For example if based on the age of the user, if a user's target for heart rate is set at "X" and the user is below "X" resistance at any given zone or group of zones may be increased. Conversely if the target heart rate of "X" is surpassed resistance at any given zone or group of zones may be decreased.

Since certain changes may be made in the above apparatus without departing from the scope of the invention herein involved, it is intended that all matter contained in the above description, as shown in the accompanying drawing, shall be interpreted in an illustrative, and not a limiting sense.

I claim:

1. A method of exercise comprising:

providing two supported pivoting arms each with a grip attached thereto;

providing a rotating hub attached to each pivoting arm at a common pivot wherein each hub has a magnetically attractive region thereon and each pivoting arm and attached hub is rotatably movable around said common pivot 360 degrees;

each hub being divided into radially spaced zones, with discrete identifiers on each zones;

providing a movable magnetic device in close proximity to each hub wherein moving the magnetic device varies the magnetic field being applied to the hub's defined zone or zones;

placing a user between the arms;

positioning said pivoting arm and attached hub in relation to said magnetic field within a predetermined zone;

the user grasping the grips and moving the grips at least once around a 360 degree guided circular pathway; and varying the magnetic field applied to the defined zones on the hubs at least once during movement of each arm around said 360 degree guided circular pathway.

2. The method of claim 1 wherein the variation of the magnetic field is determined at least in part from action data in a LUT wherein said action data includes a measurement of at least one of time between two or more zones, difference between the rate the zones of each hubs are moving when the hubs are moving in same direction, difference between the rate the zones of each hubs are moving when the hubs are moving in different directions, and rate of movement between a group of zones.

3. The method of claim 2 wherein the variation of the magnetic field is determined at least in part from sensor data provided from machine readable data measuring action data during exercise wherein said machine readable data read by the sensor is at least one of color, texture, glyphs, bar codes, spaced magnets, IR tags, and RF tags.

4. The method of claim 2 wherein the variation of the magnetic field is determined by, in addition to action data, at least in part from personal state data provided from one or more physical state sensors.

5. The method of claim 1 the method further comprising the guided circular pathway includes moving the grips at least one of below the user's thighs and behind the user's front.

6. The method of claim 2 wherein the LUT is constructed at least in part from a user test.

* * * * *